US008522680B2

(12) United States Patent
Angevine

(10) Patent No.: US 8,522,680 B2
(45) Date of Patent: Sep. 3, 2013

(54) APPARATUS FOR FORMING EMBOSSED AND PRINTED IMAGES

(76) Inventor: Faye Angevine, Taipei (TW)

( * ) Notice: Subject to any disclaimer, the term of this patent is extended or adjusted under 35 U.S.C. 154(b) by 805 days.

(21) Appl. No.: 12/636,623

(22) Filed: Dec. 11, 2009

(65) Prior Publication Data

US 2011/0139021 A1 Jun. 16, 2011
US 2012/0137905 A9 Jun. 7, 2012

Related U.S. Application Data

(63) Continuation-in-part of application No. 13/142,087, filed as application No. PCT/CN2009/001119 on Oct. 9, 2009.

(30) Foreign Application Priority Data

Oct. 7, 2008 (CN) ..... 2008 2 0136624 U

(51) Int. Cl.

| | |
|---|---|
| ***B31F 1/07*** | (2006.01) |
| ***B44B 5/00*** | (2006.01) |
| ***B44C 1/24*** | (2006.01) |
| ***B26F 1/44*** | (2006.01) |

(52) U.S. Cl.
USPC ..... 101/28; 101/4; 101/26

(58) Field of Classification Search
USPC ..... 101/26, 28, 30, 32, 3.1, 4
See application file for complete search history.

(56) References Cited

U.S. PATENT DOCUMENTS

| | | | |
|---|---|---|---|
| 756,902 | A | 4/1904 | Shoemaker |
| 896,478 | A | 8/1908 | Stockman |
| 1,453,405 | A | 5/1923 | Platt |
| 1,658,823 | A | 2/1928 | Willard |
| 1,992,250 | A | 2/1935 | Stacey |
| 2,005,340 | A | 6/1935 | Jaffin |
| 2,019,009 | A | 10/1935 | Hendrix |
| 2,029,567 | A | 2/1936 | Hough |
| 2,112,011 | A | 3/1938 | Byerlein |
| 2,260,183 | A | 10/1941 | Leslie |
| 2,458,867 | A | 1/1949 | Messersmith |
| 2,595,970 | A | 5/1952 | McGill |
| 2,612,123 | A | 9/1952 | Nord |
| 2,619,173 | A | 11/1952 | Crain |
| 2,625,908 | A | 1/1953 | Knott |
| 2,641,781 | A | 6/1953 | Haskell |

(Continued)

FOREIGN PATENT DOCUMENTS

| | | | |
|---|---|---|---|
| CN | 2211340 | Y | 8/1995 |
| CN | 2285195 | Y | 1/1998 |

(Continued)

*Primary Examiner* — Ren Yan
*Assistant Examiner* — Marissa Ferguson Samreth
(74) *Attorney, Agent, or Firm* — Morriss O'Bryant Compagni, PC

(57) ABSTRACT

A printing and embossing folder includes a first panel member having a plurality of holes and a second panel member hingedly coupled to the first panel member having a plurality of holes in corresponding relationship to the holes of the first panel member. A set of design tiles include positive relief designs disposed thereon. A corresponding set of design tiles have either negative relief designs for embossing or no relief for printing. The tiles can be positioned at any desired location on the folder so long as the positive design tiles are positioned opposite a corresponding tile for either embossing or printing. Inserting a sheet of paper within the folder and pressing the folder will cause the design to be embossed or printed into the paper.

36 Claims, 15 Drawing Sheets

(56) References Cited

U.S. PATENT DOCUMENTS

| | | | |
|---|---|---|---|
| 2,703,023 | A | 3/1955 | Sarno |
| 2,791,029 | A | 5/1957 | Leo |
| 2,821,871 | A | 2/1958 | Sarno |
| 2,876,575 | A | 3/1959 | Leika |
| 2,885,933 | A | 5/1959 | Phillips |
| 3,064,559 | A | 11/1962 | Treer |
| 3,094,091 | A | 6/1963 | Peccerill |
| 3,170,358 | A | 2/1965 | Martin |
| 3,182,530 | A | 5/1965 | Scott et al. |
| 3,228,263 | A | 1/1966 | Bien |
| 3,250,163 | A | 5/1966 | Smith |
| 3,261,044 | A | 7/1966 | Hoff |
| 3,266,358 | A | 8/1966 | Cox et al. |
| 3,383,969 | A | 5/1968 | Saunders |
| D211,608 | S | 7/1968 | Gray |
| 3,400,625 | A | 9/1968 | Wrona |
| 3,531,863 | A | 10/1970 | Sandborn |
| 3,534,440 | A | 10/1970 | Roberts |
| 3,587,382 | A | 6/1971 | Boyd |
| 3,667,334 | A | 6/1972 | Brunett |
| 3,744,384 | A | 7/1973 | Jarritt et al. |
| 3,756,553 | A | 9/1973 | Ranz |
| 2,245,770 | A | 6/1974 | Franzmann |
| 3,863,550 | A | 2/1975 | Sarka et al. |
| 3,926,032 | A | 12/1975 | Brooks et al. |
| 3,935,811 | A | 2/1976 | Lenz et al. |
| 3,986,447 | A | 10/1976 | Zimmer |
| 4,052,886 | A | 10/1977 | Buick |
| 4,065,990 | A | 1/1978 | Edhlund |
| D257,777 | S | 1/1981 | Eichenberg et al. |
| 4,278,017 | A | 7/1981 | Conjura |
| 4,345,516 | A | 8/1982 | Sinclair |
| 4,444,075 | A | 4/1984 | Mulry |
| 4,462,291 | A | 7/1984 | Schulz |
| 4,516,923 | A | 5/1985 | Lifshitz et al. |
| 4,537,546 | A | 8/1985 | Lucas |
| 4,542,691 | A | 9/1985 | Kokrhanek |
| 4,579,022 | A | 4/1986 | Kasai et al. |
| 4,602,661 | A | 7/1986 | Heller et al. |
| 4,625,592 | A | 12/1986 | Bayens |
| 4,638,731 | A | 1/1987 | Kato |
| 4,692,198 | A | 9/1987 | Borresen |
| D296,565 | S | 7/1988 | Eichenberg et al. |
| 4,761,988 | A | 8/1988 | Kato |
| 4,763,551 | A | 8/1988 | Halff et al. |
| 4,818,207 | A | 4/1989 | Heron |
| 4,913,463 | A | 4/1990 | Tlapek et al. |
| 4,979,613 | A | 12/1990 | McLaughlin et al. |
| 4,981,061 | A | 1/1991 | Hillock et al. |
| D319,771 | S | 9/1991 | Reid et al. |
| 5,054,389 | A | 10/1991 | Kuhlman et al. |
| 5,112,423 | A | 5/1992 | Liebe, Jr. |
| 5,129,157 | A | 7/1992 | Wood |
| 5,135,533 | A | 8/1992 | Peterson et al. |
| 5,140,872 | A | 8/1992 | Holliday et al. |
| 5,172,622 | A | 12/1992 | Sabin |
| 5,181,464 | A | 1/1993 | Kuhlman et al. |
| 5,188,026 | A | 2/1993 | Fuqua et al. |
| 5,230,156 | A | 7/1993 | Patenaude |
| 5,255,587 | A | 10/1993 | Eichenberg et al. |
| D341,842 | S | 11/1993 | Eichenberg et al. |
| 5,275,076 | A | 1/1994 | Greenwalt |
| 5,368,672 | A | 11/1994 | Gunzelman et al. |
| 5,383,996 | A | 1/1995 | Dressler |
| D359,967 | S | 7/1995 | Eichenberg et al. |
| 5,488,889 | A | 2/1996 | Kang |
| 5,544,549 | A | 8/1996 | Helferich |
| 5,544,576 | A | 8/1996 | Kato |
| 5,579,582 | A | 12/1996 | Carlson |
| 5,590,910 | A | 1/1997 | Meth |
| 5,622,106 | A | 4/1997 | Rayner |
| 5,628,226 | A | 5/1997 | Weissman |
| D380,488 | S | 7/1997 | Elstad et al. |
| 5,647,278 | A | 7/1997 | Wu |
| 5,660,105 | A | 8/1997 | Benson et al. |
| D384,572 | S | 10/1997 | Ongaro |
| 5,722,319 | A | 3/1998 | Hirano |
| 5,761,982 | A | 6/1998 | Abt et al. |
| 5,775,213 | A | 7/1998 | Hyde |
| 5,778,748 | A | 7/1998 | Beijen |
| 5,916,335 | A | 6/1999 | Gerhardt |
| 6,000,139 | A | 12/1999 | Chan |
| 6,170,376 | B1 | 1/2001 | Strobel et al. |
| 6,311,601 | B1 | 11/2001 | Love |
| 6,539,844 | B1 | 4/2003 | Bart |
| 6,543,131 | B1 | 4/2003 | Beroz et al. |
| 6,626,965 | B2 | 9/2003 | Workman et al. |
| 6,658,978 | B1 | 12/2003 | Johnson |
| 6,739,244 | B1 | 5/2004 | Carbaugh |
| 7,104,192 | B1 | 9/2006 | Corcoran |
| 7,201,101 | B2 | 4/2007 | Oh |
| 7,246,704 | B2 | 7/2007 | Brunson et al. |
| 7,469,634 | B2 | 12/2008 | Caron et al. |
| 2002/0117288 | A1 | 8/2002 | Furukoshi et al. |
| 2002/0139164 | A1 | 10/2002 | Ishihara |
| 2003/0118689 | A1 | 6/2003 | Carlson et al. |
| 2004/0020328 | A1 | 2/2004 | Wang |
| 2004/0118304 | A1 | 6/2004 | Corcoran et al. |
| 2005/0028644 | A1 | 2/2005 | Hughes |
| 2005/0045522 | A1 | 3/2005 | Corcoran |
| 2005/0050936 | A1 | 3/2005 | Hughes et al. |
| 2005/0056166 | A1 | 3/2005 | Corcoran et al. |
| 2005/0061168 | A1 | 3/2005 | Corcoran et al. |
| 2005/0132861 | A1 | 6/2005 | Deng et al. |
| 2005/0211041 | A1 | 9/2005 | Oh |
| 2005/0215405 | A1 | 9/2005 | Corcoran |
| 2005/0253324 | A1 | 11/2005 | Corcoran et al. |
| 2005/0268761 | A1 | 12/2005 | Corcoran et al. |
| 2006/0027109 | A1* | 2/2006 | Criss ..... 101/28 |
| 2007/0107610 | A1* | 5/2007 | Lee ..... 101/28 |
| 2010/0064911 | A1* | 3/2010 | Davis et al. ..... 101/26 |

FOREIGN PATENT DOCUMENTS

| | | |
|---|---|---|
| CN | 1227166 | 9/1999 |
| CN | 2451301 Y | 10/2001 |
| CN | 2467286 Y | 12/2001 |
| CN | 2555993 | 6/2003 |
| CN | 01127727 | 9/2004 |
| CN | 2748294 Y | 12/2005 |
| CN | 2785882 | 6/2006 |
| CN | 2902761 | 5/2007 |
| CN | 200991578 | 12/2007 |
| CN | 201261344 | 6/2009 |
| DE | 3206718 | 9/1983 |
| GB | 2 272 661 | 5/1994 |
| JP | 04-217497 | 8/1992 |
| JP | 11-034184 | 2/1999 |
| JP | 11-091296 | 4/1999 |
| JP | 11091296 | 4/1999 |
| JP | 2000-127095 | 5/2000 |
| WO | WO 03/016035 | 2/2003 |

* cited by examiner

H
H
30
28
11
28
32
1
21
30
28
29
32
13
34
12
11
M
L
4

60
62
64
52

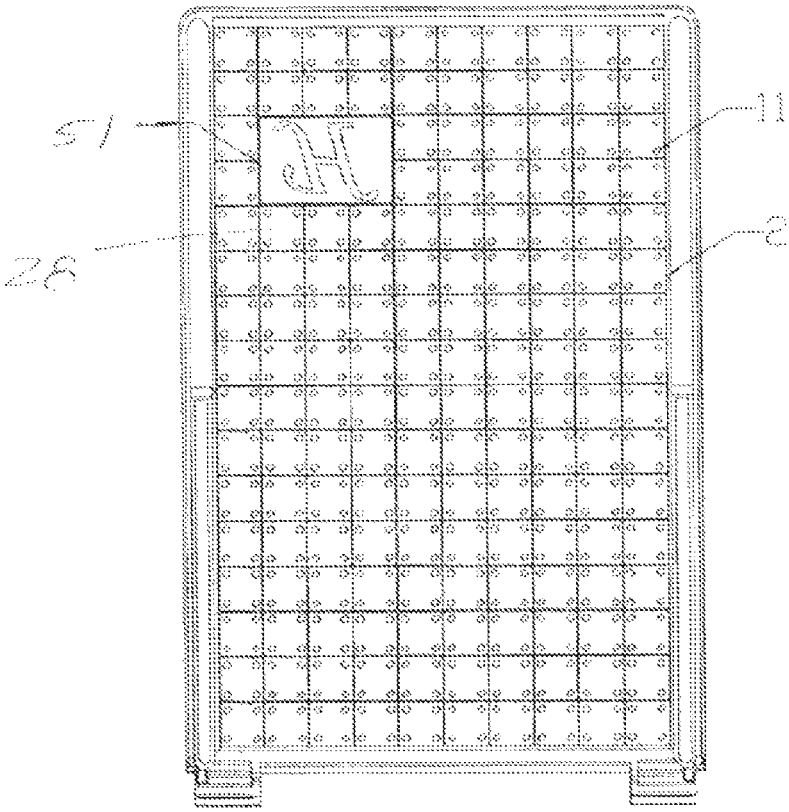
FIG. 6
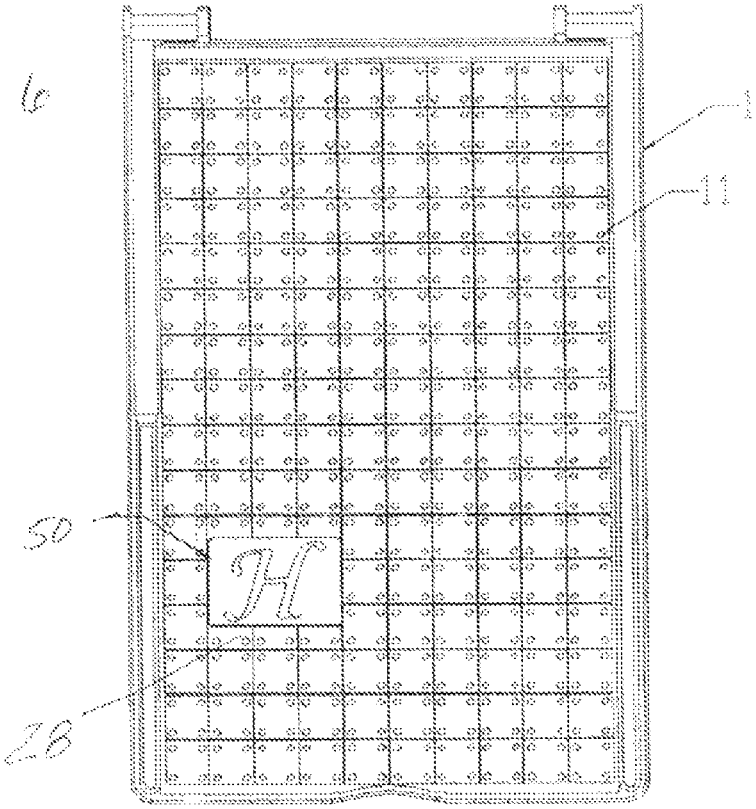

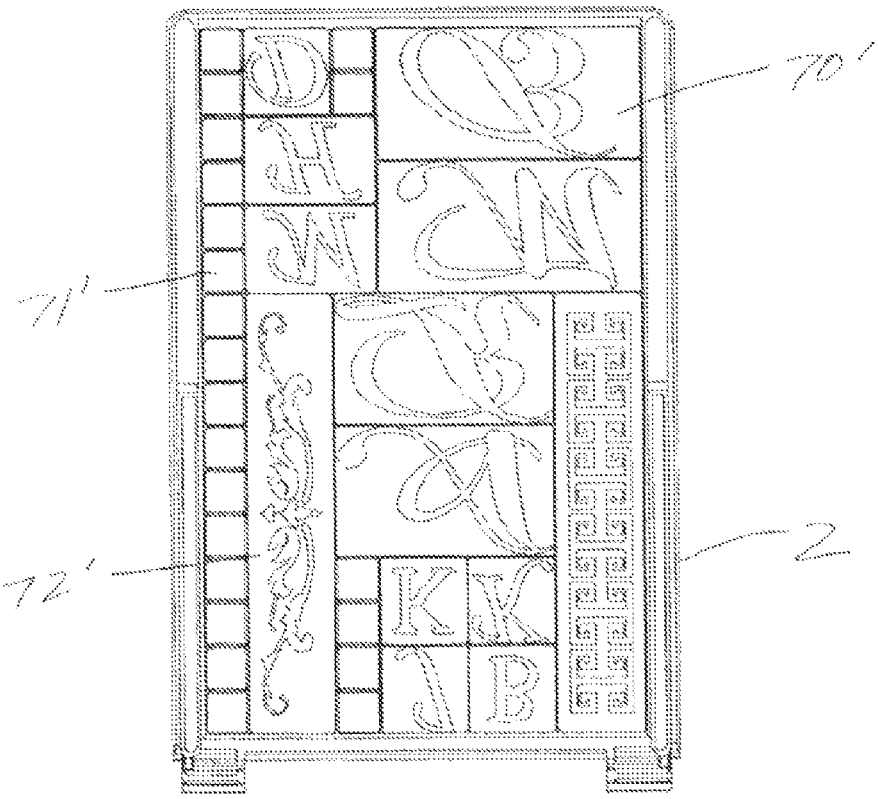
FIG. 7
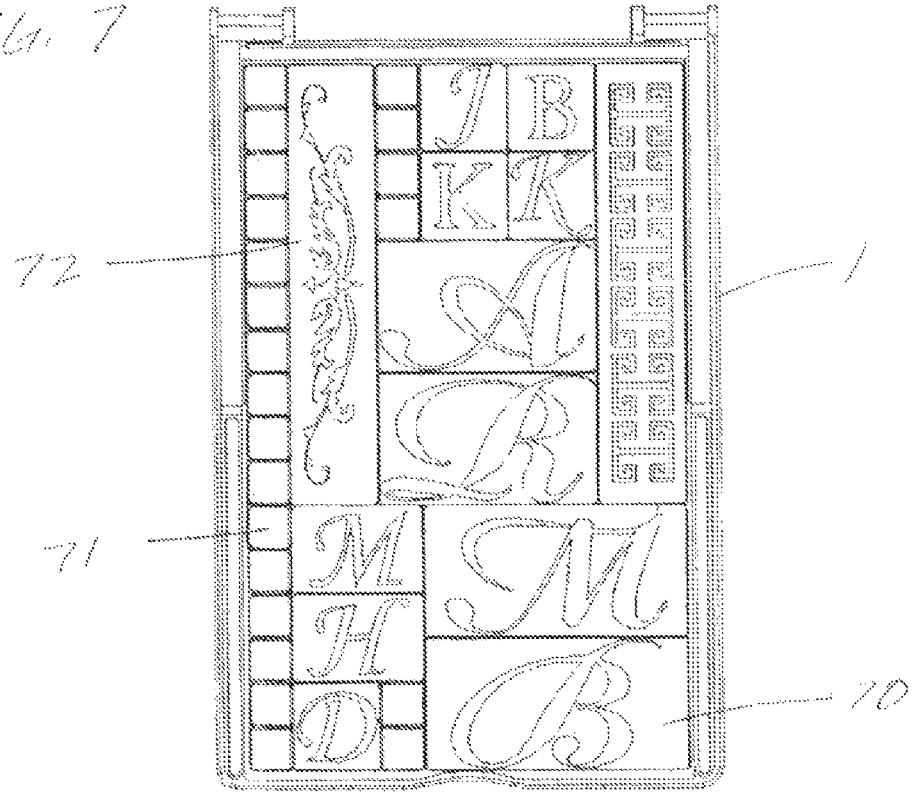

APPARATUS FOR FORMING EMBOSSED AND PRINTED IMAGES

CROSS-REFERENCE TO RELATED APPLICATIONS

This application is a Continuation-in-Part and claims the benefit of the filing date of U.S. application Ser. No. 13/142,087 which is the National Stage under 35 U.S.C. §371 of International Application No. PCT/CN09/01119 filed Oct. 9, 2009, which claims the benefit of China Patent Application No. 200820136624.6, filed on Oct. 7, 2008.

BACKGROUND

1. Field of the Invention

The present invention relates generally to devices for creating embossed or printed images and more specifically, to an embossing or printing folder that includes interchangeable parts for producing embossed or printed images on paper when used in combination with a die press.

2. Background of the Invention

Various forms of die presses have been developed through the years which use individual die cutting blocks having blades, formed into a particular shape that are individually pressed against one or more sheets of paper to produce paper die cuts. More recently, such machines have been employed to produce embossed images in paper by subjecting an embossing device having a sheet of paper sandwiched therein to pressure generated by the die press. Each such prior art cutting or embossing device has been of a preset configuration with one or more preset images formed into the device. Thus, in order to generate a different image using such a device, a completely new device containing the desired image or pattern must be used.

Thus, there exists a need in the art to produce an embossing or printing folder that is capable of producing various embossed or printed images, patterns or other forms on paper using a single device with interchangeable components.

SUMMARY OF THE INVENTION

According to the present invention, a hinged paper embossing and printing device is provided with a plurality of interchangeable pieces that are temporarily held in the embossing device. In the case of embossing, a plurality of pairs of small plastic pieces having different patterns is inserted into small holes of large plastic sheets so as to press and emboss or print on paper inserted therein.

In one embodiment, the embossing and printing device is provided with a base panel and a top panel, the base and top panels being hingedly coupled to one another along one edge of each panel. The inner surfaces of each of the panels are provided with a plurality of holes for receiving protrusions provided on the back side of one or more pairs of insertable image pieces.

In an embossing configuration, each pair of insertable image pieces provides stereo relief images of one another so that recesses of one piece of the pair receive raised portions of the other piece of the pair, and vice versa.

In a printing configuration, a reverse image of the image to be printed on a sheet of paper is provided as a positive image on one or more of the image pieces. Corresponding pair pieces having flat surfaces are provided opposite the image pieces to provide a flat surface upon which the positive image can be pressed. Ink is placed on the positive image piece and a sheet of paper is placed between the top and base panels.

Pressing of the top and base panel together, causes the ink on the positive image piece to be transferred to the paper.

To provide a hinge-type construction between the top and bottom panels, the base panel is provided with a pair of oppositely opposing tabs each having a pair of protrusions inwardly extending there from. The top panel is provided with a pair of tabs having through holes provided therein for engaging with the protrusions of the tabs of the bottom panel. The protrusions can snap into the through holes and pivot relative thereto thereby forming a hinge that allows the top and bottom panels to freely fold and unfold.

Each pair of image pieces are provided with positive and negative reliefs of the same image formed therein so that when pressed together raised portions of one piece will fit within the corresponding recessed portion of the corresponding piece.

The profiles of each piece can be machined or molded into the embossing and printing sides for generating printed patterns. The back sides of each piece are provided with protruding pegs for being received and held within corresponding holes formed in the inside surfaces of the base and top panels.

Accordingly, the present invention provides a device for embossing and printing that is of relatively simple construction and easy to assemble, of low cost and relatively easy to manufacture. The device for embossing and printing is easy to operate and allows end users to produce customized embossed and printed papers by selecting pieces of their own choosing.

The foregoing advantages and characterizing features will become apparent from the following description of certain illustrative embodiments of the invention. The above-described features and advantages of the present invention, as well as additional features and advantages, will be set forth or will become more fully apparent in the detailed description that follows and in the appended claims. The novel features which are considered characteristic of this invention are set forth in the attached claims. Furthermore, the features and advantages of the present invention may be learned by the practice of the invention, or will be obvious to one skilled in the art from the description, as set forth hereinafter.

BRIEF DESCRIPTION OF THE DRAWINGS

The following drawings illustrate exemplary embodiments for carrying out the invention. Like reference numerals refer to like parts in different views or embodiments of the present invention in the drawings.

FIGS. 2A and 2B illustrate a top and cross-sectional side view, respectively of a base panel member of FIG. 1.

FIGS. 4A and 4B illustrate a design tile having a positive relief in accordance with the principles of the present invention.

FIG. 6 is a plan view of the printing and embossing folder with the design tiles illustrated in FIGS. 4A and 5A attached thereto.

FIG. 7 is a plan view of the printing and embossing folder with a plurality of different design tiles attached thereto according to the principles of the present invention.

DETAILED DESCRIPTION OF THE ILLUSTRATED EMBODIMENTS

Figure 1:
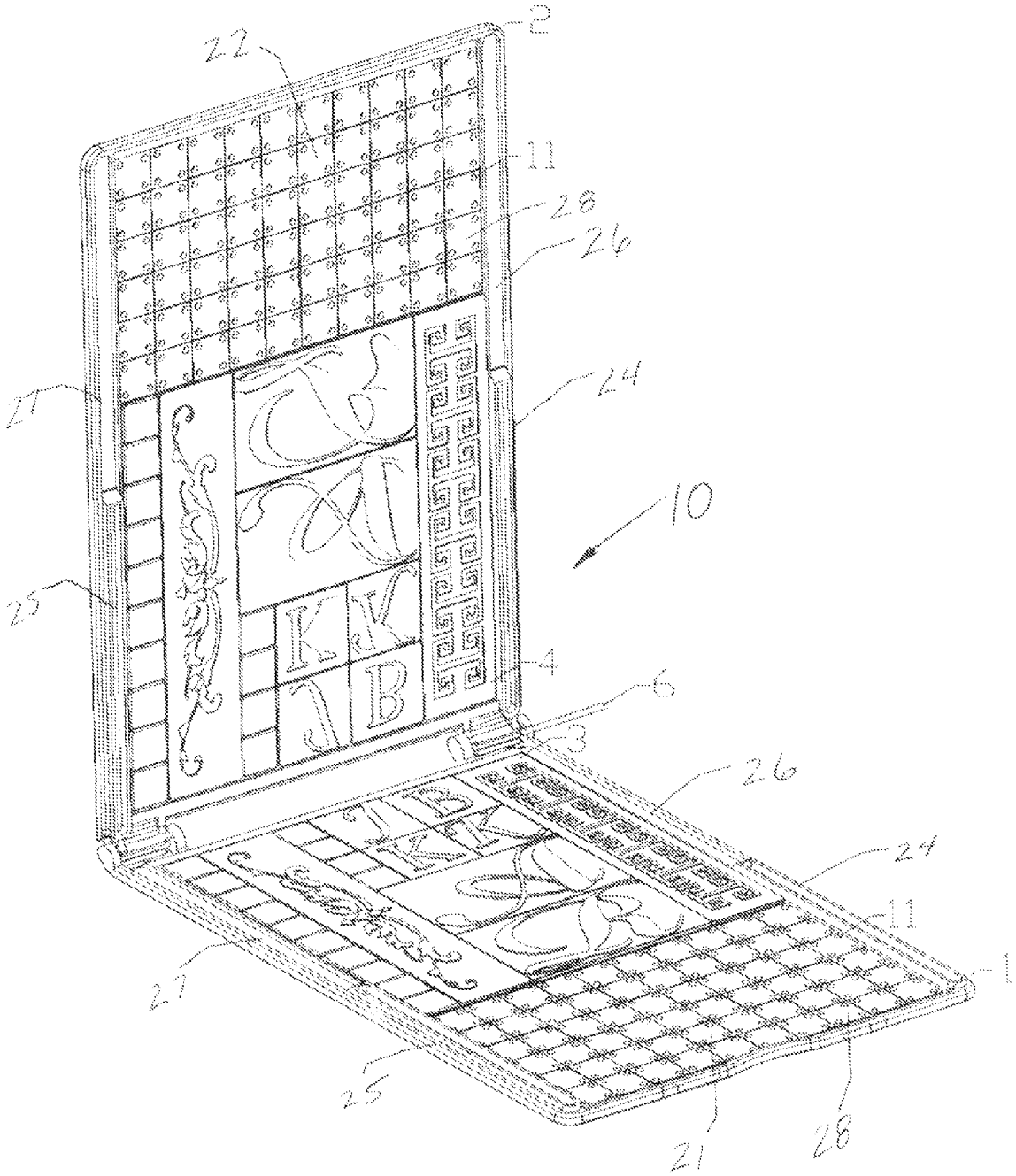
FIG. 1 is a perspective side view of a first embodiment of a printing and embossing folder according to the principles of the present invention.
Figures 23, 24:
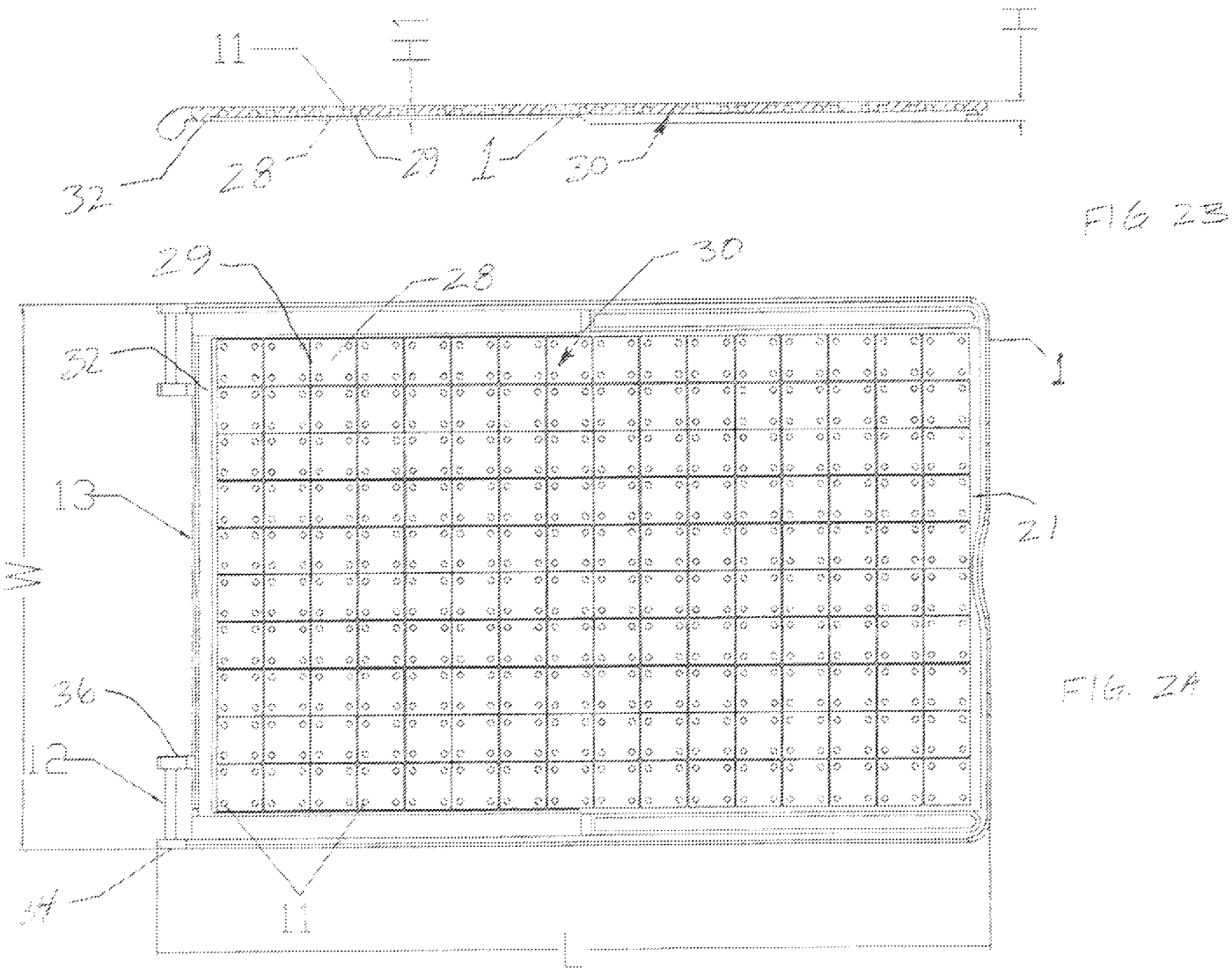

As shown in FIG. 1, there is illustrated a hinged paper embossing and printing folder, generally indicated at 10, in accordance with the principles of the present invention. The folder 10 is comprised of a bottom panel member 1 and a top panel member 2 that are hingedly attached to each other with hinge mechanism 6. The bottom and top panel members 1 and 2, respectively, are of substantially the same size and shape so that the opposing surfaces 21 and 22, respectively, are aligned and positioned adjacent to each other in a closed position. It should be noted that while the panel members 1 and 2 are referred to herein as top and bottom, respectively, the embossing and printing folder 10 can function equally well with the panel member 1 positioned on top and the panel member 2 positioned on the bottom. Thus, reference herein to the "top" and "bottom" is made for convenience and not by way of limitation.

To help align the bottom and top panel members 1 and 2, each is provided with elongate protrusions 24 and 25 and recesses 26 and 27 positioned along the edges of each panel member 1 and 2. When folded together, the protrusions 24 and 25 mate with respective recesses 26 and 27. Because the protrusions are essentially trapezoidal in cross-sectional shape, the sides of the protrusions 24 and 25 can enter the respective recesses 26 and 27 even if not perfectly aligned and as they are forced together will bring the two into substantially perfect alignment as the sides of the protrusions 24 and 25 slide into engagement with the inside surfaces of the recesses 26 and 27. Alignment of the top and bottom panel members 2 and 1, respectively, is important for the embossing function to make sure that the corresponding embossing tiles 3 and 4 will properly mate when pressed together.

The opposing faces 21 and 22 are each divided into a grid of a plurality of individual squares 28. Each square 28 is provided with four holes 11 that are positioned proximate the corners of each square 28. The holes may be spaced approximately 0.5 inches apart. The squares are in abutting arrangement and are fixedly integrated into each panel member 1 and 2. Individually designed tiles 3 and 4 are temporarily coupled to the panel members 1 and 2 with legs or pegs (not visible) that protrude from the back of the tiles 3 and 4 and engage with the holes 11 to hold the tiles 3 and 4 in place. The pegs engage with the holes 11 with a slight friction fit or a snapping action to hold the tiles 3 and 4 in place during use that also allows the tiles 3 and 4 to be easily removed from the panel members 1 and 2. In this particular example, the tile 3 includes a protruding relief design on the top surface thereof. The tile 4 includes a recessed relief of the same design. When a sheet of paper is placed between the panels 1 and 2, the panels 1 and 2 are firmly pressed together, as by running the folder 10 through a roller press machine known in the art, the raised relief design of the tile 3 and overlying sheet of paper is forced into the recessed relief design of the tile 4 causing the paper to be imprinted or embossed with the design. The other tiles illustrated in FIG. 1 have a similar mating relationship so as to cause paper embossing in a similar fashion with the design of the particular tiles. Of course, the positive and negative relief tiles could be intermixed so that some of the positive relief tiles, such as tile 3, are coupled to the panel member 1 while other positive relief members of other designs are positions on the panel member 2. This allows various embossing designs to be created with both negative and positive reliefs simultaneously formed in the paper. Moreover, because there is virtually no limit to the designs of the tiles or to the positions of the tiles on the panel members 1 and 2, a limitless number of custom embossed images can be created. It should also be noted that while the present embodiment is illustrated as having holes in the panel members 1 and 2 for holding the tiles with pegs, the panels could provide pegs with holes provided in the backs of the tiles.

Figure 3A:
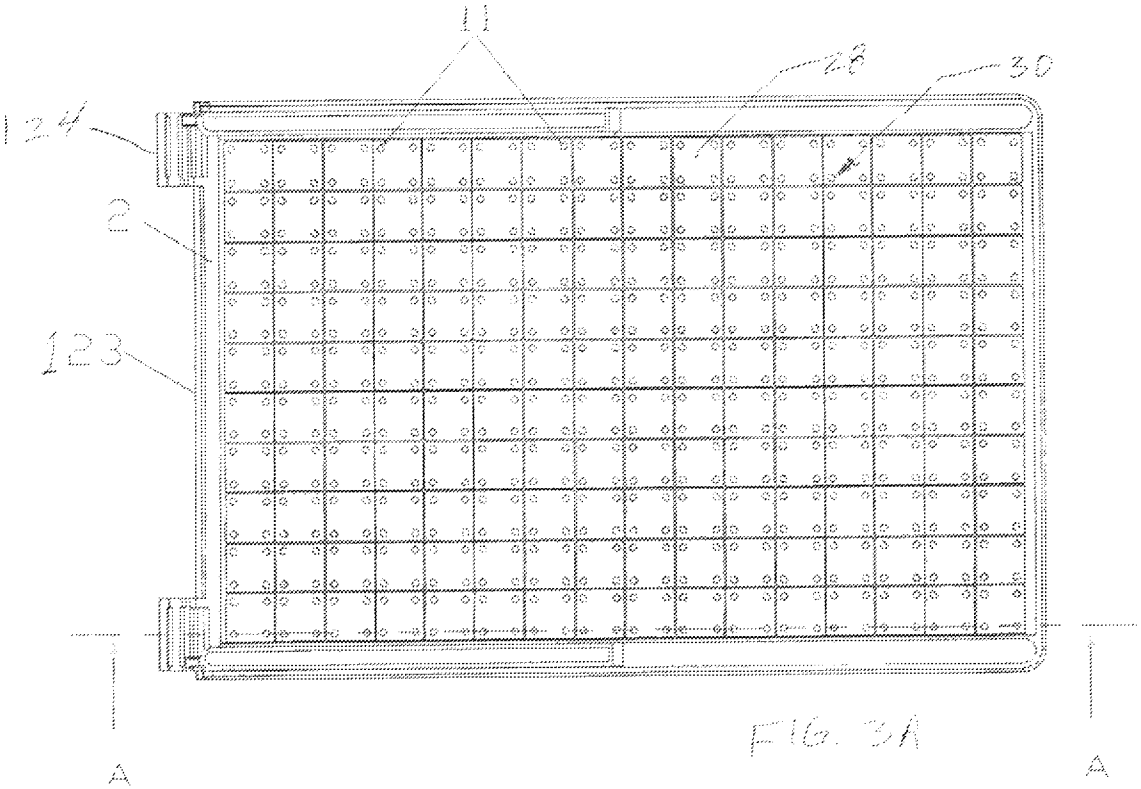
FIGS. 3A and 3B illustrate a top and cross-sectional side view, respectively of a top panel member of FIG. 1.
Figure 3B:
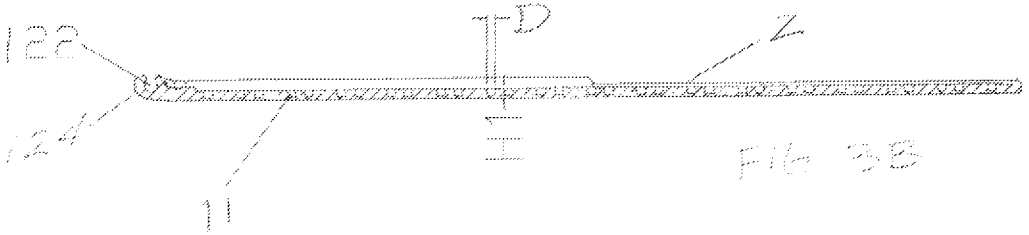

As illustrated in FIGS. 2A and 2B, the base panel member 1 includes a grid of equally spaced squares 28 disposed over a substantial portion of the inner surface 21. Each square is defined by a small groove 29 that circumscribes each square 28. The entire grid 30 of squares 28 is slightly recessed into the surface 21 such that a raised perimeter 32 is formed around the grid 30. Each square 28 is provided with a plurality of holes 11 (four in this embodiment) that are disposed proximate the corners of each square 28. The holes 28 extend a distance into the panel member 1, but do not extend completely through the panel member 1. To form a hinge 6, as shown in FIG. 1, a pair of laterally positioned hinge pins 12 is attached to the panel member 1 with protruding hinge pin support members 34 and 36 along the hinge side 13 of the panel member 1. The hinge pins 12 are configured to snap into hinge components provided in the upper panel member as shown in FIGS. 3A and 3B herein. It is further contemplated that other hinge-type arrangements may be employed including forming the two panels 1 and 2 from a single piece of material, such as plastic with a "living" hinge interconnecting the two panel members along an entire length of one side or partially along one side. Likewise, the hinge may be provided by a piece of adhesive tape that interconnects the two panels to form a hinge.

The sizes of base member 1 may be of any reasonable size and shape and may be configured to fit within the throat of a particular brand and model of die cut press known in the art. Thus, folder 10 may have a width W to length L ratio of 4 to 6, with the height H to width ratio being about 4 to 1. The height H may be 1 to 4 mm and the diameter of each hole 11 may be about 1.6 mm with the hole depth H1 being 0.8 to 3.8 mm.

Figure 3C:
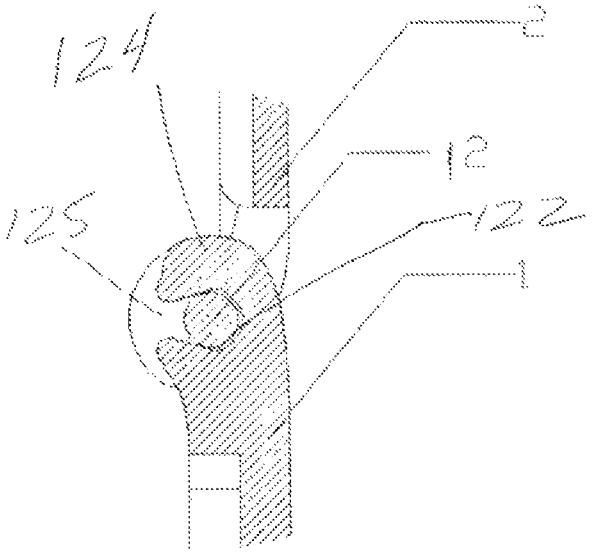
FIG. 3C illustrates a partial cross-sectional side view of a hinge structure in accordance with the principles of the present invention.

As illustrated in FIGS. 3A and 3B, the top panel member 2 is similarly configured to the base member 1, but in essentially an opposite configuration. That is, the panel member 2 includes a grid 30 of squares 28, each having identically configured holes 11 in identical arrangement, in this example four per square. The hinge side 123 is provided with hinge pin brackets 124 that define pin retaining channel 122. As shown in FIG. 3C, the channel 122 has a slightly narrower opening 125 than the width of the hinge pin 12 so that the hinge pin 12 can snap into the hinge pin bracket 124. This way, the hinge pin bracket 124 can retain the hinge pin therein to form a hinge between the panel members 1 and 2. As shown in FIG. 3B, a cross-section along line A-A, the top panel member 2 includes holes 11 having a depth H1 that is less than the thickness of the panel member 2 at that location and a width diameter D that is similar to the depth H1.

Referring now to FIGS. 4A and 4B and FIGS. 5A and 5B, there are illustrated cooperating embossing tiles 50 and 51, each representing the letter "H" in this example. The embossing tile 50 is comprised of a base 52 defining a top surface 53 and a bottom surface 54. The surfaces 53 and 54 are essentially planar. A raised design 56 is provided on the top surface 53 to define a positive relief thereon. A plurality of legs or pegs 58 are provided on and depend from the bottom surface 54 to extend outwardly therefrom. The pegs 58 are configured to mate with the holes 11 provided on the base or top panel members 1 and 2 and have a height H3 that is substantially equal to the depth H1 of the holes 11. The corresponding embossing tile 51 has a similar but mirrored configuration such that the design element 60 is recessed into the top surface 62 of the base 64 of the tile. The design element 60 forms a negative relief in the top surface 62 of the base 64 and is slightly larger in all dimensions than the positive relief design 56. This allows the positive relief design 56 to at least partially fit within the negative relieve design 60 along with an interposed sheet of paper to be embossed. As with the tile 50, a plurality of legs or pegs 66 are configured to engage with and be retained by the holes 11 in the surfaces of the panel members 1 and 2. Each tile may vary in size from about inch squares representing the smallest tile to 2×3 inches or more depending on the size of the folder. It is noted that the size of each tile is irrelevant so long as it can fit inside the folder and snap into the holes. The base and top panels, as well as the individual tiles, can be made from plastic materials such as PE, PS, PVC, PP, and ABS, or other materials known in the art.

As illustrated in FIG. 6, the tiles 50 and 51 can be positioned in any position on the panel members 1 and 2 so long as the pegs mate with the holes 11. Thus, the tiles 50 and 51 can be positioned within certain squares 28 or across squares 28. To use properly, however, the tiles 50 and 51 must be positioned in the same relative location of each panel member 1 and 2. As illustrated, when the two panels members 1 and 2 are brought together once hinged together, the tiles 50 and 51 would be offset in their current locations. Thus, either the tile 50 needs to be moved down one and a half squares or the tile 51 needs to move down one and a half squares. The grooves forming gridlines on each panel help the user easily visually position the tiles to be exactly opposite each other for proper embossing functionality.

As shown in FIG. 7, various corresponding tiles, tiles 70 and 70', 71 and 71', 72 and 72', etc., may be placed on the panel members 1 and 2 to form a particular embossed design. Where no tiles are needed for the desired design that would otherwise result in gaps between design tiles or along the edge of a design, blank tiles 71 and 71' may be employed. The blank tiles 71 and 71' have a thickness that matches the thickness of the design tiles minus any positive relief element. This provides a uniform and substantially planar surface so as to prevent the edges of the design tiles from forming creases in the paper during the embossing process.

Figure 8:
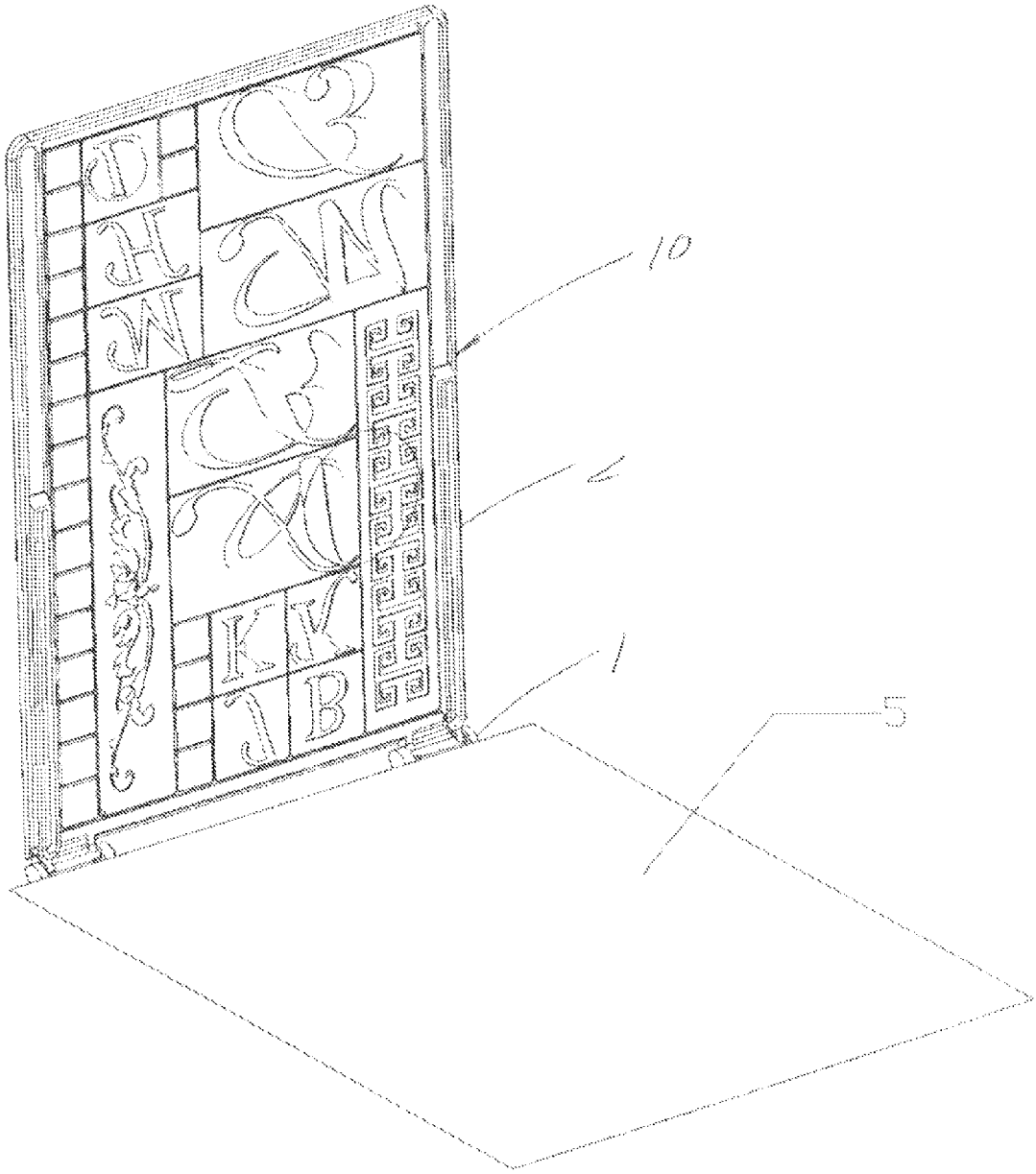
FIG. 8 is a perspective side view of the printing and embossing folder with a sheet of paper disposed therein and the folder in an open position.
Figure 9:
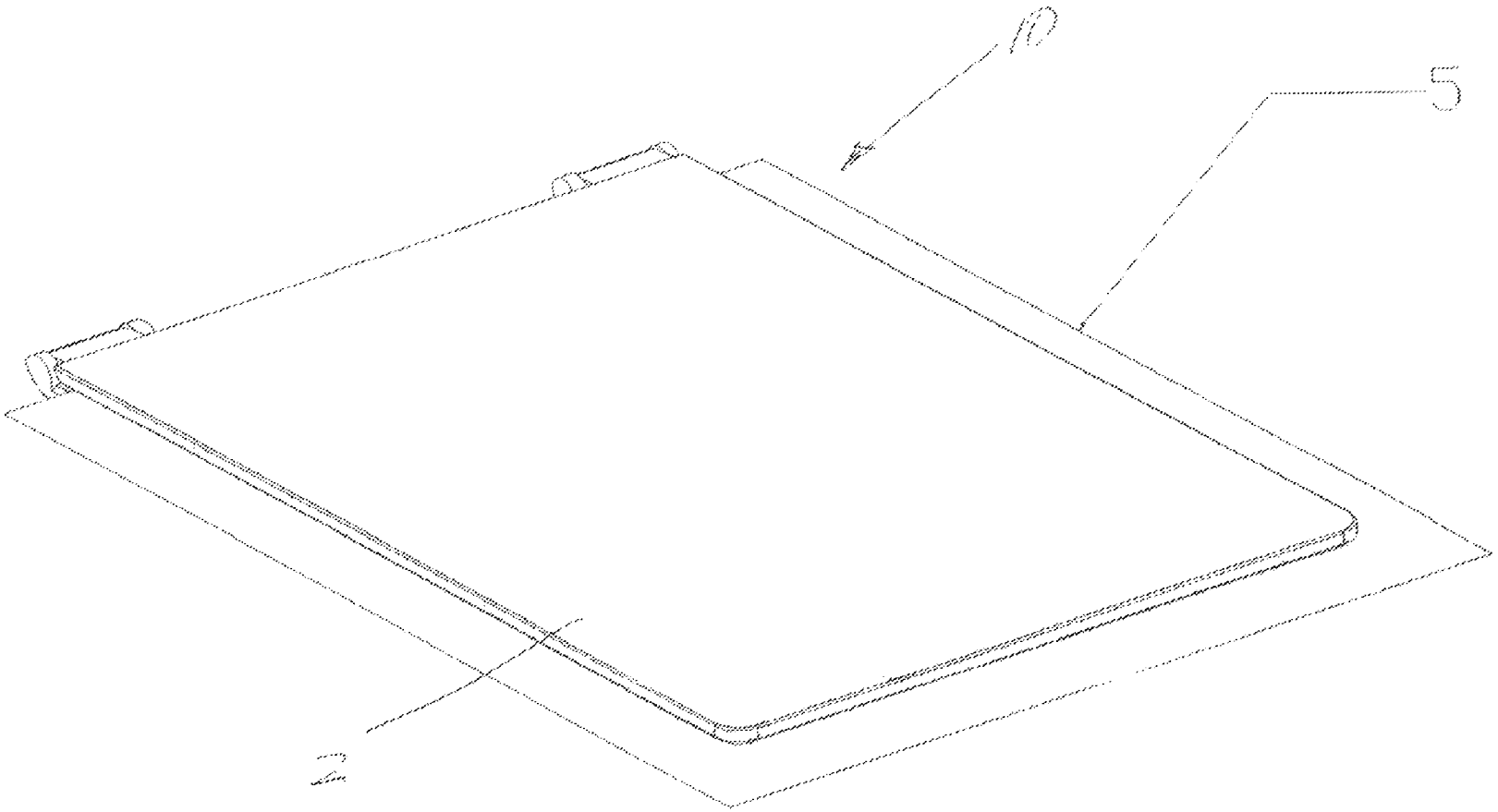
FIG. 9 is a perspective side view of the printing and embossing folder with the sheet of paper disposed therein and the folder in a closed position.
Figure 10:
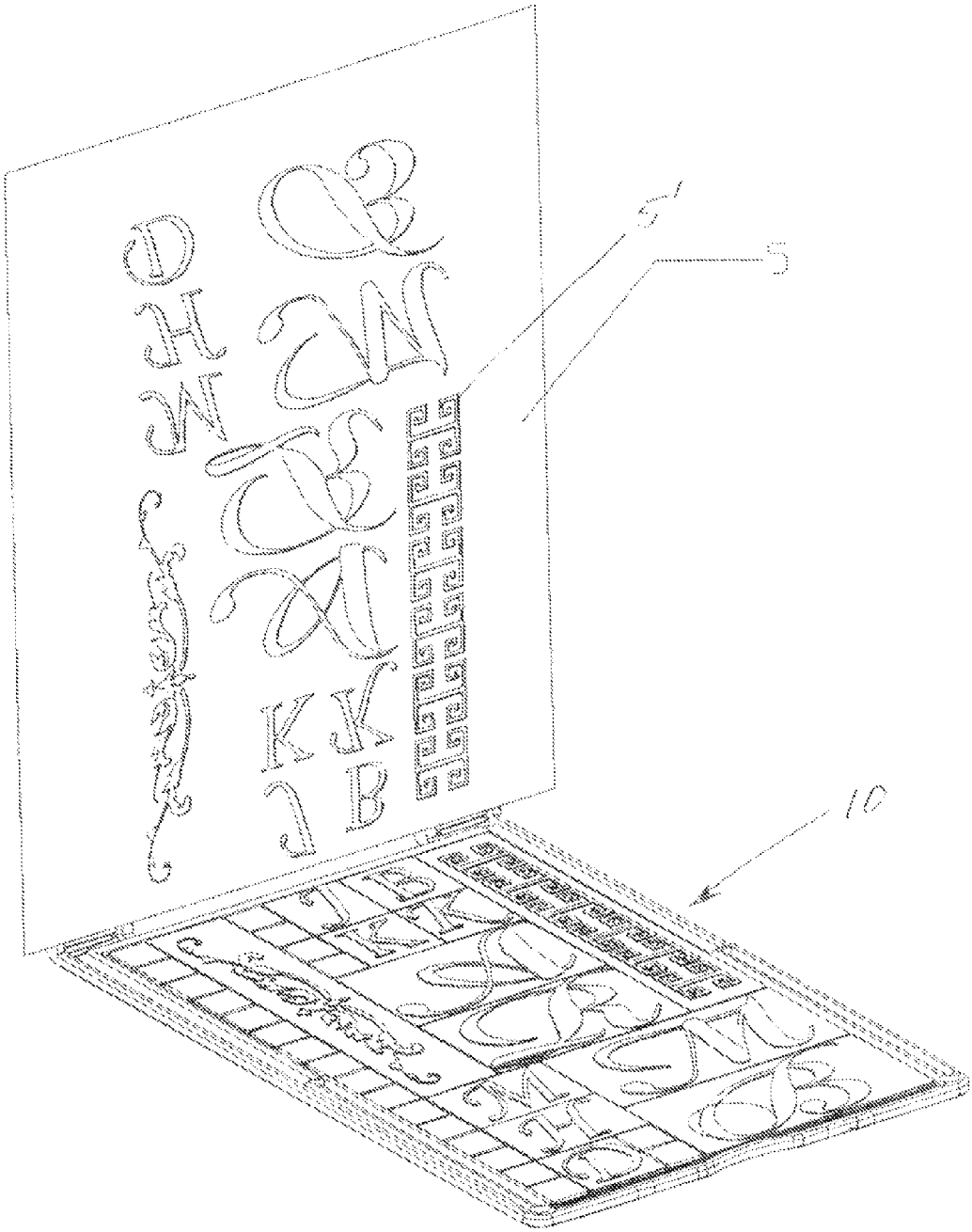
FIG. 10 is a perspective side view of the printing and embossing folder with the sheet of paper having been embossed and the folder in an open position.

In use, as illustrated in FIG. 8, the folder 10 is opened and various design tiles and blank tiles, such as the tiles 70, 70', 71, 71', 72 and 72' shown in FIG. 7, are placed on the panels 1 and 2 as illustrated. A sheet of paper 5 to be embossed is inserted between the two panel members 1 and 2. As shown in FIG. 9, the top panel member 2 is closed in a clam-shell fashion over the paper 5 and the folder 10 is pressed as by running the folder 10 through a roller die press, placing the folder 10 in another type of hand operated press as is known in the art, or by hand by applying pressure with a hand-held object such as a rolling pin. When opened, the paper 5 will include embossed designs 5' that match the designs provided by the tiles as illustrated in FIG. 10. While illustrated as extending beyond the width and length of the folder 10, the paper 5 could be of any size, including a smaller size that completely fits within the folder 10 when closed.

Figure 11:
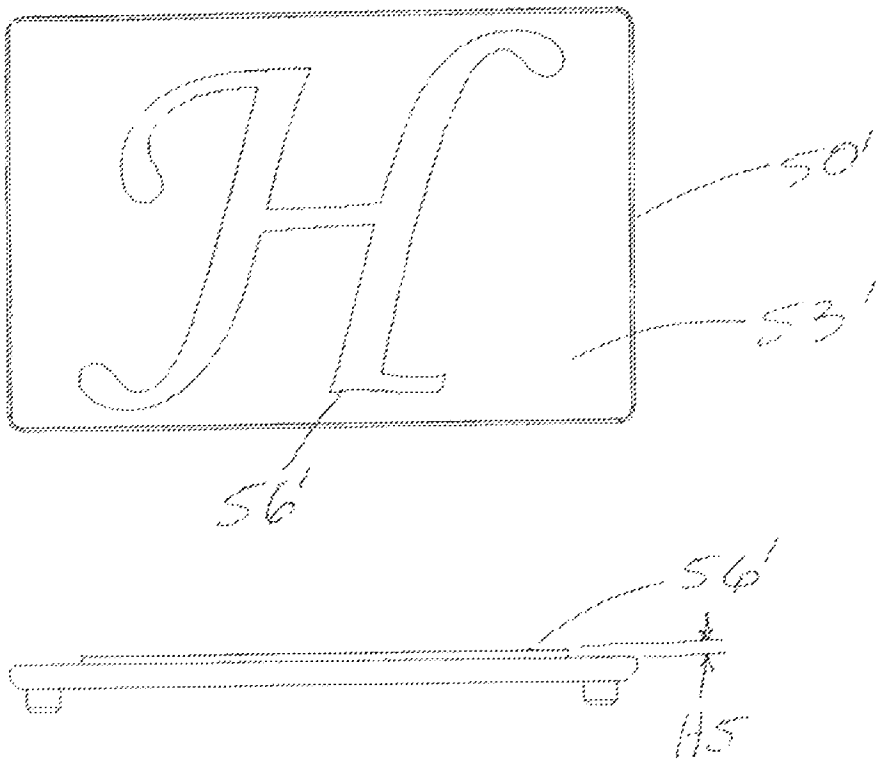
FIG. 11A is a top and side view of a printing and embossing tile in accordance with the principles of the present invention.
FIG. 11B is a top and side view of a printing tile in accordance with the principles of the present invention.
Figure 11B:
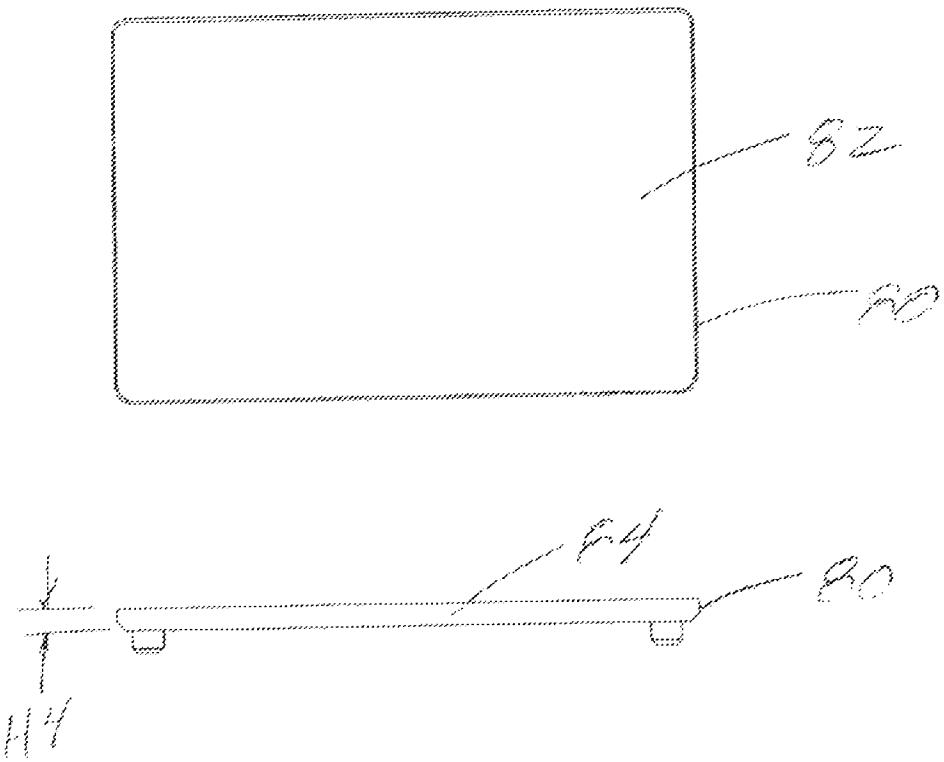
Figure 12:
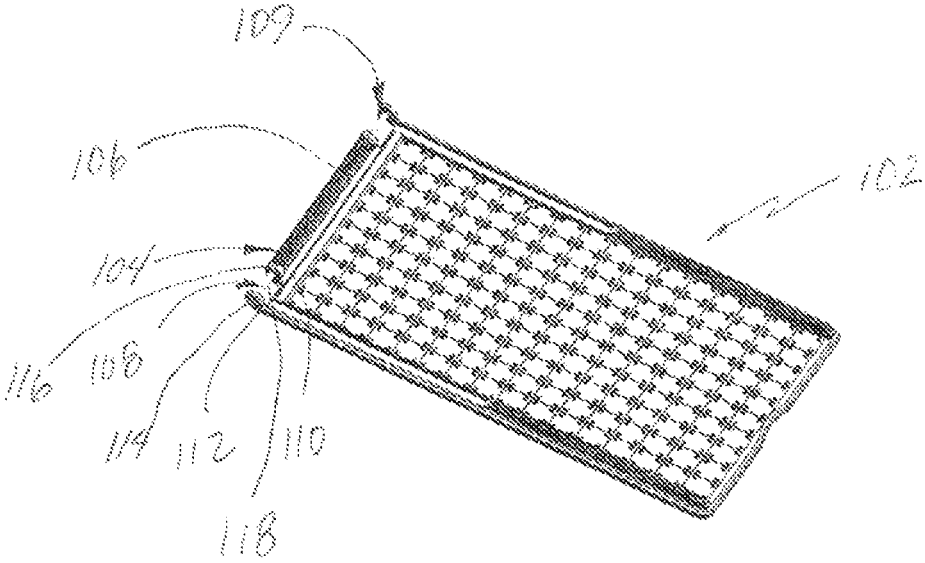

As illustrated in FIGS. 11A and 11B, the same positive relief image tile 50' can be employed to print onto the sheet of paper 5, previously shown, rather than embossing. To print, rather than providing a corresponding tile 51 that has a similar design image but in negative relief, a printing tile 80 is positioned opposite the design tile 50'. The printing tile 80 is a blank tile that presents a flat surface to allow the raised portion 56' to press against the flat surface 82 of the printing tile 80. Because the raised portion 56' is not allowed to fit within the printing tile 80, as is the case when used with an embossing tile 51, the thickness of the base 84 of the tile 80 has a thickness H4 that is thinner than the corresponding base of the tile 51 by the height H5 of the raised design 56'. This provides the same effective combined height of the tiles 50' and 80 when the folder 10 is closed as with the tiles 50' and 51 and thus allows the folder to completely close so that the panels 1 and 2 are substantially parallel during the printing process to ensure uniform pressure along the entire surface of the paper being printed. This improves print quality and prevents damage to the folder 10 that may otherwise occur from uneven pressures.

In order to keep the ink from smearing or bleeding, the positive relief is configured to be slightly higher than with the similar tile for embossing. This provides additional space between the paper and the top surface 53' of the tile 50' to reduce the possibility of contact of the paper and the surface 53' that may contain ink. It is also contemplated that the folder and tiles could be used to imprint clay or other moldable material to create embossed or recessed designs in the material.

To print, an ink is applied to the raised surface 56 of the design tile 50 and the folder is used as previously described with the tile 50 pressing against the tile 80 with the paper 5 interposed therein between. The result is similar to that illustrated in FIG. 10 except that the designs on the paper will be in ink rather than embossed. Likewise, an ink containing sheet, such as those used for carbon copies, or label making could be inserted with the ink side facing the paper and the non-ink side against the raised tile or the blank tile. The pressure of the raised design of the raised tile against the blank tile will cause the ink on the sheet to transfer to the paper, similar to the ribbon of a typewriter.

Figures 12, 14:
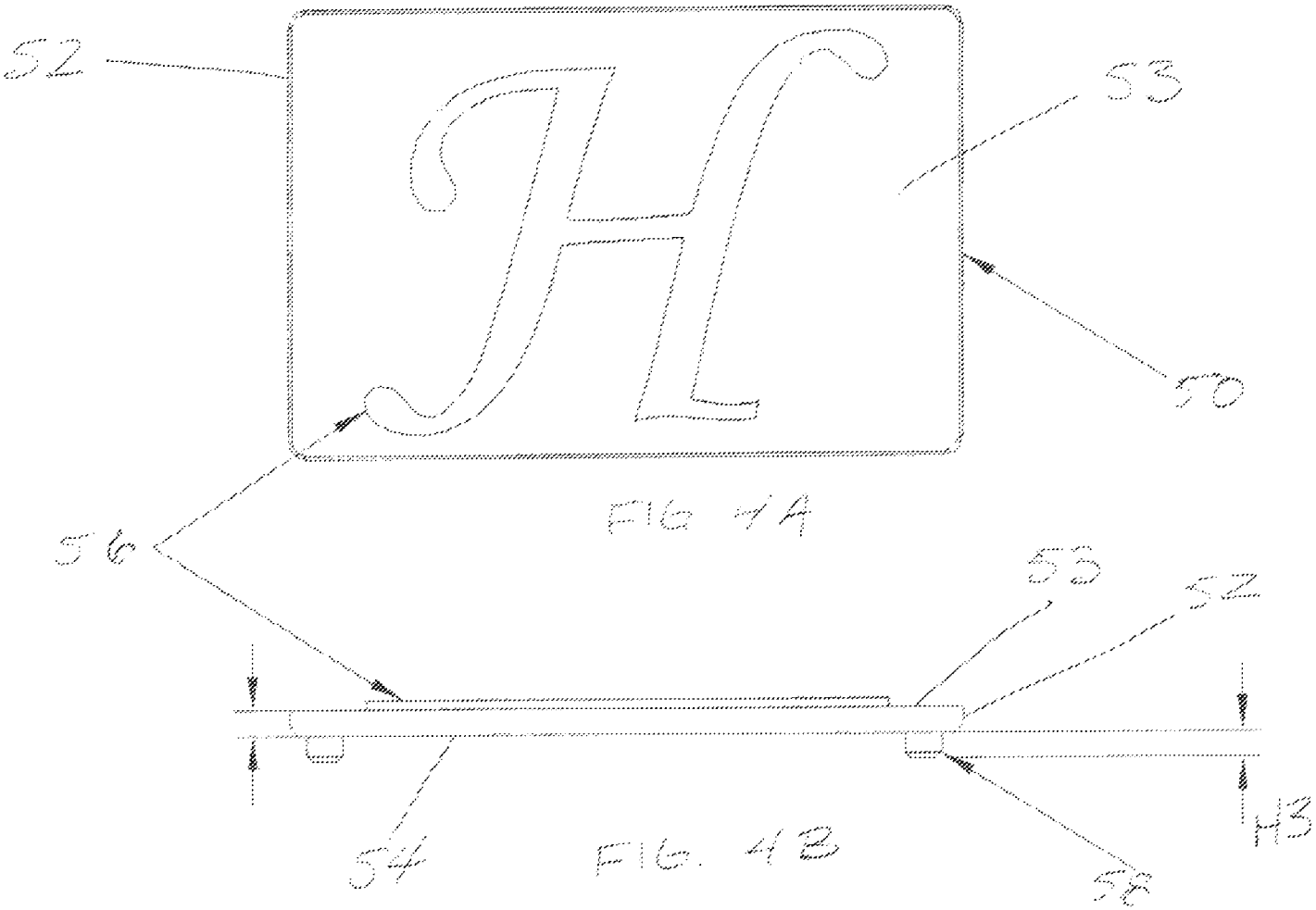
FIG. 12 is a perspective top view of an alternative embodiment of a bottom panel member of an embossing folder in accordance with the principles of the present invention.
FIG. 14 is a perspective back side view of a second embodiment of a printing and embossing folder according to the principles of the present invention.
Figures 5A, 5B:
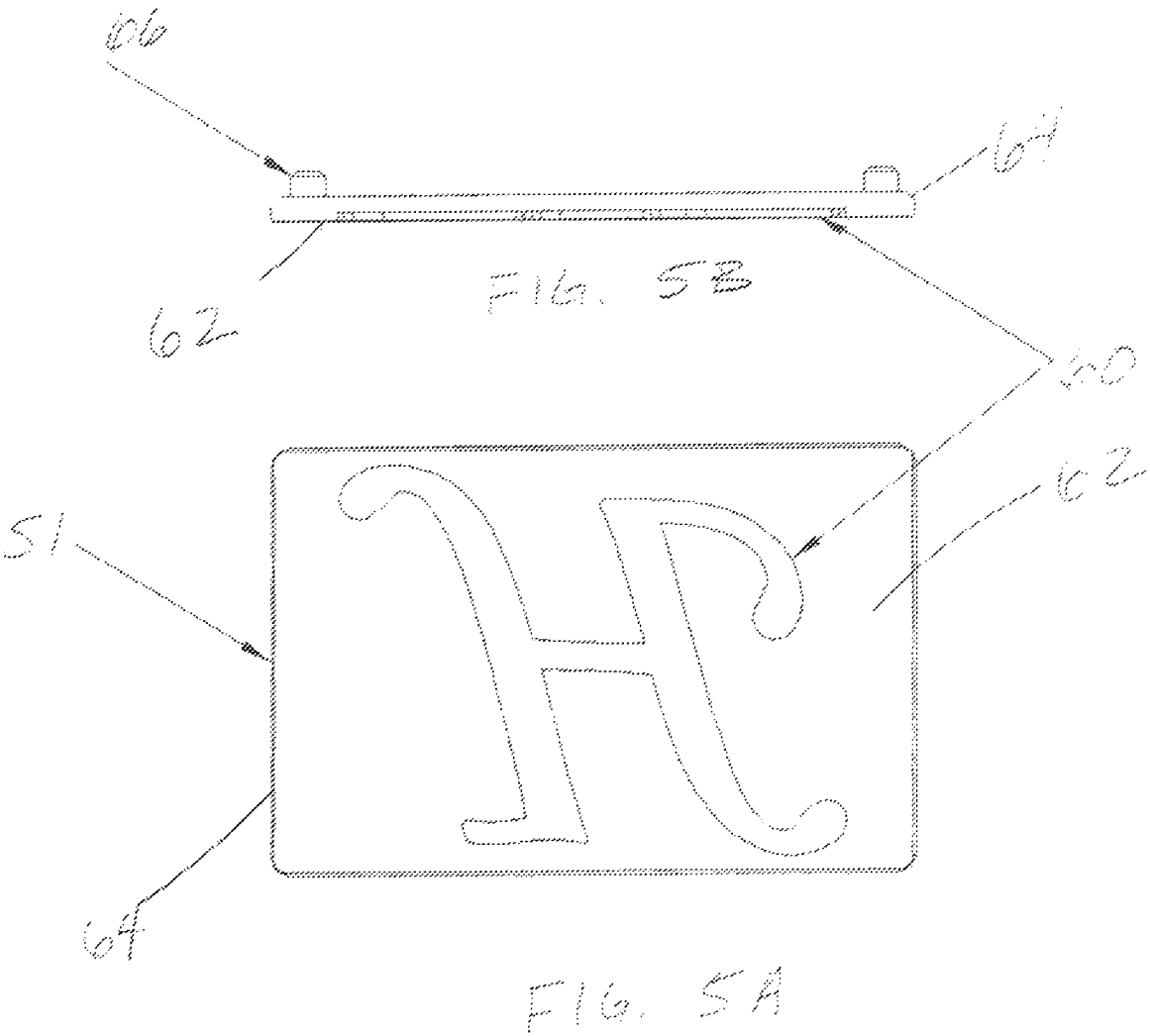
FIGS. 5A and 5B illustrate a design tile having a negative relief that corresponds to the positive relieve of the design tile illustrated in FIG. 4A in accordance with the principles of the present invention.
Figure 13:
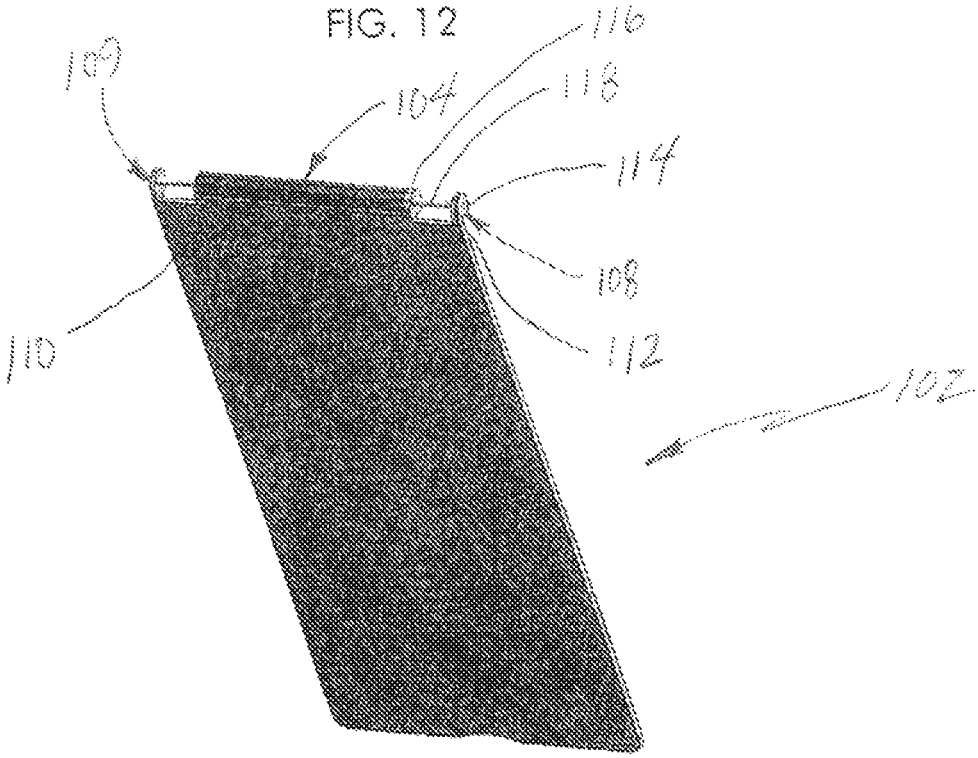
FIG. 13 is a perspective bottom view of the bottom panel member illustrated in FIG. 12.
Figure 14:
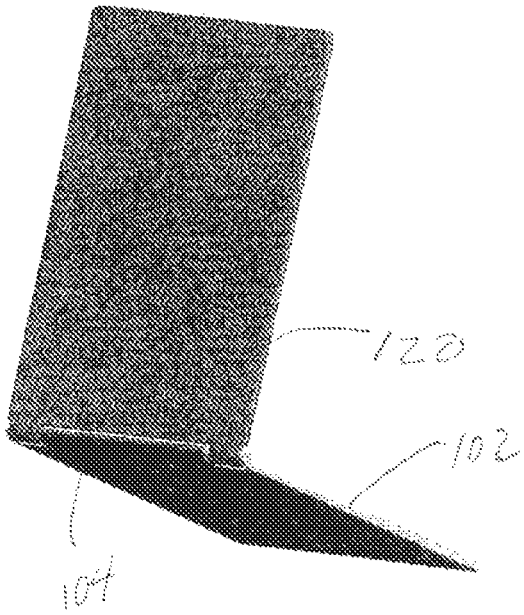

As illustrated in FIGS. 12 and 13, a bottom panel, generally indicated at 102, of an embossing folder is provided with a hinge assembly, generally indicated at 104, that includes a cylindrically shaped elongate member 106, that spans the space between a first hinge structure 108 and a second hinge structure 109. The hinge structure 108 and 109 is positioned on an edge 110 of the panel 102 proximate to a corner 112.

The hinge structure 108 includes a first tab 114 depending from the edge 110 and a second tab 116 spaced from the first tab 114 also depending from the edge 110. A cylindrical hinge pin 118 spans the space between the first and second tabs 114 and 116 and is also spaced from and substantially parallel to the edge 110. The hinge pin 118 is held in place by the first and second tabs 114 and 116. The hinge structure 109 is similarly configured but positioned proximate the opposite side of the panel 102. The elongate member 106 is held between the first and second hinge structures 108 and 109. To do so, the hinge pin 108 may extend from the hinge structure 108 to the hinge structure 109. The elongate member 106 may be provided with a central bore through which the hinge pin 118 may pass. Likewise, the elongate member 106 may be provided with end recesses to receive protrusions extending from the facing walls of the tabs, such as tab 116. It is also contemplated that the elongate member 106 could be integrally formed with the bottom panel 102 along the edge 110 thereof.

Figure 15:
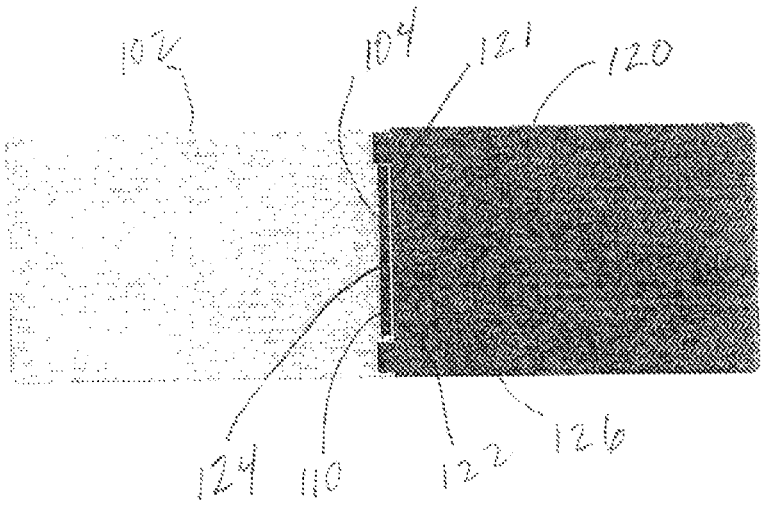
FIG. 15 is a back side view of the printing and embossing folder illustrated in FIG. 14.

As illustrated in FIGS. 14 and 15, when assembled to a top panel 120, the space 121 that would otherwise exist between the adjacent edges 110 and 122 of the panels 102 and 120, respectively, is primarily occupied by the elongate member 104. In operation, as the bottom and top panels 102 and 120 are laid open relative to each other as shown in FIG. 15, the space edges 124 and 126 that define the space 121 decreases in size. Without the elongate member 104, a user could potentially pinch a finger in the space 121. The elongate member 104 thus provides a safety feature that allows the panels 102 and 120 to freely pivot relative to each other while occupying the space 121 to prevent pinching of skin.

Of course, a combination of printing and embossing could be simultaneously employed during the same pressing process so that the sheet of paper 5 is simultaneously printed with ink, paint or other pigmented material and embossed. It should be noted that the folder 10 of the present invention and tiles, such as tiles 3, 4, 50, 51 and 80 herein described may be formed of any material, such as plastic or metal and may be formed by injection molding, machining or other methods known in the art.

While there have been described what are believed to be the best embodiments of the present invention, those skilled in the art will recognize that other and further changes and modifications may be made thereto without department from the spirit of the invention, and it is intended to claim all such changes and modifications that fall within the true scope of the invention. In addition, while the devices set forth herein have been described with specific reference to a particular structure and shape, the device of the present invention could be modified to any desired shape or size. Thus, while various methods and systems of the present invention are described herein, any methods or devices similar or equivalent to those described herein may be used in the practice or testing of the present invention. All references cited herein are incorporated by reference in their entirety and for all purposes.

While the foregoing advantages of the present invention are manifested in the illustrated embodiments of the invention, a variety of changes can be made to the configuration, design and construction of the invention to achieve those advantages. Hence, reference herein to specific details of the method and function of the present invention is by way of example only and not by way of limitation. Unless defined otherwise, all technical and scientific terms used herein have the same meanings as commonly understood by one of ordinary skill in the art to which this invention belongs. It is also to be understood that, as used herein and in the appended claims, the singular forms "a," "an," and "the" include plural reference, unless the context clearly dictates otherwise.

What is claimed is:

1. A printing and embossing folder, comprising;

a first panel member having a first surface defining a first plurality of holes;

a second panel member hingedly coupled to the first panel member having a second surface defining a second plurality of holes in corresponding relationship to said first plurality of holes and in alignment to said first plurality of holes when the first and second panel members are in a closed position;

a first plurality of tiles each having a different positive relief design disposed on a first side thereof and at least one peg depending from a second side thereof, said at least one peg removably coupled to at least one of said first plurality of holes; and a second plurality of tiles each having a first side and having at least one peg depending from a second side thereof, said at least one peg of the second plurality of tiles removably coupled to at least one of said second plurality of holes so that each of the second plurality of tiles is aligned with the positive relief design of a corresponding one of the first plurality of tiles when said first and second panel members are in a closed position, the positive relief design of each of the first plurality of tiles defining a first planar surface above the first surface of the first panel member and the second side of each of the second plurality of tiles defining a second planar surface above the second surface of the second panel member so that each positive relief design of the first plurality of tiles engages with a second side of each of the second plurality of tiles when said first and second panel members are in a closed position causing each positive relief design to engage with each corresponding second plurality of tiles.

2. The folder of claim 1, wherein said first plurality of holes forms a first grid and said second plurality of holes forms a corresponding second grid such that said first and second plurality of holes are in precise alignment when said first and second panel members are in a closed position and the first and second plurality of tiles can be placed in various configurations one the first and second panel memebers.

3. The folder of claim 1, wherein said first and second panel members include a hinge interposed between said first and second panel members along one edge of each thereof.

4. The folder of claim 3, wherein said hinge comprises a first hinge structure and a second hinge structure spaced along an edge of said first panel member and an elongate member interposed between said first and second hinge structures to prevent pinching of skin between said first and second panel members as said first and second panel members are opened relative to each other.

5. The folder of claim 1, wherein said second plurality of tiles each define a negative relief in said top surface having a design corresponding in shape and relative size to the positive relief of said first plurality of tiles so that said positive relief can at least partially fit within said negative relief to allow embossing on a sheet of paper disposed therein between.

6. The folder of claim 1, wherein said at least one peg of said at least one first tile comprises a plurality of pegs for mating with a corresponding number of holes of said first plurality of holes.

7. The folder of claim 6, wherein said at least one peg of said at least one second tile comprises a plurality of pegs for mating with a corresponding number of holes of said second plurality of holes.

8. The folder of claim 1, wherein said at least one second tile defines a planar top surface for abutting said positive relief of said at least one first tile to allow printing on a sheet of paper disposed therein between.

9. The folder of claim 1, wherein said second plurality of tiles define a negative relief in said top surface having a design corresponding in shape and relative size to the positive relief of said first plurality of tiles so that said positive relief can at least partially fit within said negative relief to allow embossing on a sheet of paper disposed therein between.

10. The folder of claim 1, wherein said first and second plurality of holes are arranged in a grid, where each square within the grid comprises at least two holes.

11. The folder of claim 10, wherein each square within the grid includes four holes, with each hole proximate a corner of each square.

12. The folder of claim 10, wherein a plurality of the first and second plurality of tiles are larger than a square of the grid.

13. The folder of claim 1, wherein the first surface of the first panel is slightly recessed within the first panel.

14. The folder of claim 1, wherein the second surface of the second panel is slightly recessed within the second panel.

15. A printing and embossing folder, comprising:

a first panel member defining a first plurality of holes in a first surface thereof, the first plurality of holes arranged in a first rectangular grid;

a second panel member hingedly coupled to said first panel member defining a second plurality of holes in a second surface thereof, the second plurality of holes arranged in a second rectangular grid;

a first set of tiles each having a different positive relief disposed on a front side thereon and at least one peg extending therefrom on a back side thereof for selective positional attachment to the first plurality of holes of said first panel member at a desired location;

a second set of tiles, a first plurality of said second set of tiles each having a corresponding negative relief to a corresponding plurality of said first set of tiles the first set of tiles and a second plurality of said second set of tiles disposed therein or defining a planar surface for engaging with said positive relief of a corresponding one of said first set of tiles and at least one peg extending from a back side thereof for selective positional attachment to the second plurality of holes of said second panel member in a position opposite to said first set of tiles to engage with said first set of tiles when the first and second panel members are in a closed position;

whereby inserting a sheet of paper between said first and second set of tiles and closing said first and second panels around said paper under pressure will cause embossing of the sheet of paper by said first plurality of said second set of tiles and printing on the sheet of paper by said second plurality of said second set of tiles.

16. The folder of claim 15, wherein the first panel member has a plurality of holes in a grid-like pattern disposed in an inside surface thereof and said first set of tiles has a plurality of pegs disposed thereon for mating with said plurality of holes.

17. The folder of claim 15, wherein the second panel member has a plurality of holes in a grid-like pattern disposed in an inside surface thereof and said second set of tiles has a plurality of pegs disposed thereon for mating with said plurality of holes.

18. The folder of claim 17, wherein said plurality of holes of said first and second panels are in alignment when said first and second panel members are in a closed position.

19. The folder of claim 15, wherein said first and second panel members include a hinge coupled between said first and second panel members along one edge of each thereof.

20. The folder of claim 19, wherein said hinge comprises a first hinge structure and a second hinge structure spaced along an edge of said first panel member and an elongate member interposed between said first and second hinge structures to prevent pinching of skin between said first and second panel members as said first and second panel members are opened relative to each other.

21. The folder of claim 19, wherein the hinge structure comprises a living hinge.

22. The folder of claim 15, wherein said second set of tiles comprise tiles having planar top surfaces for engaging said positive relief of said first set of tiles to allow printing on a sheet of paper disposed therein between.

23. An apparatus for printing or embossing a sheet of paper, comprising:

a first panel defining a first plurality of attachment structures on a first surface thereof, the first plurality of attachment structures arranged in a grid-like pattern comprised of a plurality of squares;

a second panel hingedly coupled to the first panel so that the first and second panels can move between an open position to a closed position, the second panel defining a second plurality of attachment structures on a second surface thereof, the second plurality of attachment structures mirroring the grid-like pattern of the first plurality of attachment structures; and a plurality of matching pairs of tiles, each pair of tiles comprising a first tile having a positive relief design disposed on a front side thereof and at least one tile attachment structure on a back side thereof for selective and removable positional attachment to the first plurality of attachment structures of the first panel at a desired location and a second tile having a front side thereof for engaging with the positive relief design and at least one tile attachment structure on a back side thereof for selective and removable positional attachment to the second plurality of attachment structures of the second panel at a location directly opposite the corresponding first tile, wherein the plurality of matching pairs of tiles comprise a plurality of different designs and wherein a plurality of first tiles and a plurality of second tiles can be simultaneously attached to the first and second panels to create an embossed or printed sheet of paper with a plurality of different designs.

24. The apparatus of claim 23, wherein the second tile comprises a blank tile.

25. The apparatus of claim 24, wherein the blank tile has a size to substantially match a size of one of the plurality of first tiles.

26. The apparatus of claim 25, wherein the blank tile is removably attached to the second panel opposite the first plurality of tiles.

27. The apparatus of claim 26, further comprising ink applied to the first plurality of tiles and a sheet of paper interposed between the first plurality of tiles and a plurality of blank tiles for imprinting the positive relief designs of the first plurality of tiles on the sheet of paper when the first plurality of tiles are pressed against the plurality of blank tiles.

28. The apparatus of claim 23, further comprising a plurality of blank tiles configured to be removably attached to the first and second panels.

29. The apparatus of claim 28, wherein each of the plurality of blank tiles have a thickness that matches a thickness of the first plurality of tiles minus a positive relief element thereof.

30. The apparatus of claim 23, wherein the grid-like pattern comprises a plurality of squares.

31. The apparatus of claim 30, wherein each of the plurality of first and second tiles have a size in height and width that is approximately a multiple of a height and width of each square of the grid-like pattern.

32. The apparatus of claim 31, wherein the plurality of the first set of tiles can be simultaneously attached to the first panel adjacent to one another in an abutting arrangement.

33. The apparatus of claim 23, wherein the first plurality of attachment structures comprises a plurality of holes and the second set plurality of attachment structures comprises a plurality of pegs configured for mating with the plurality of holes.

34. The apparatus of claim 33, wherein said plurality of holes are arranged in a grid, where each square within the grid comprises at least two holes.

35. The apparatus of claim 34, wherein each square within the grid includes four holes, with each hole proximate a corner of each square.

36. The apparatus of claim 23, further comprising a first plurality of gridlines disposed on the first surface of the first panel and a second plurality of gridlines disposed on the second surface of the second panel, the first and second plurality of gridlines mirroring each other.

* * * * *